United States Patent [19]

Beguin

[11] 3,972,178

[45] Aug. 3, 1976

[54] ELECTRICALLY POWERED TIMEPIECE

[75] Inventor: Pierre-Andre Beguin, Nods, Switzerland

[73] Assignee: Societe Suisse Pour L'Industrie Horlogere Management Services S.A., Switzerland

[22] Filed: Oct. 2, 1973

[21] Appl. No.: 402,754

[30] Foreign Application Priority Data

Oct. 13, 1972 United Kingdom ..... 4705/72

[52] U.S. Cl. ..... 58/85.5; 58/23 R; 58/4 A

[51] Int. Cl.² ..... G04B 27/08

[58] Field of Search ..... 58/4 A, 23 R, 23 A, 58/50 R, 85.5, 152 R, 63, 67, 125 R

[56] References Cited

UNITED STATES PATENTS

| | | | |
|---|---|---|---|
| 1,146,351 | 7/1915 | Schlesinger | 58/152 R |
| 3,538,703 | 11/1970 | Walton | 58/23 R |
| 3,540,207 | 11/1970 | Keeler | 58/23 R |
| 3,668,861 | 6/1972 | Mitsui | 58/50 R |
| 3,693,344 | 9/1972 | Cleusix | 58/85.5 |
| 3,695,035 | 10/1972 | Cleusix | 58/85.5 |
| 3,710,567 | 1/1973 | Cleusix | 58/85.5 X |
| 3,802,180 | 4/1974 | Boudry | 58/23 R |

*Primary Examiner*—Ulysses Weldon
*Attorney, Agent, or Firm*—Griffin, Branigan and Butler

[57] ABSTRACT

An electrically powered time-piece includes at least a minute hand and an hour hand, a high precision time standard and a motor controlled by the time standard. A positive kinematic mechanism connects the motor to the minute hand arbor and a non-positive kinematic mechanism connects the minute hand arbor to the hour hand pipe, thereby permitting the user to set the hour hand only.

9 Claims, 5 Drawing Figures

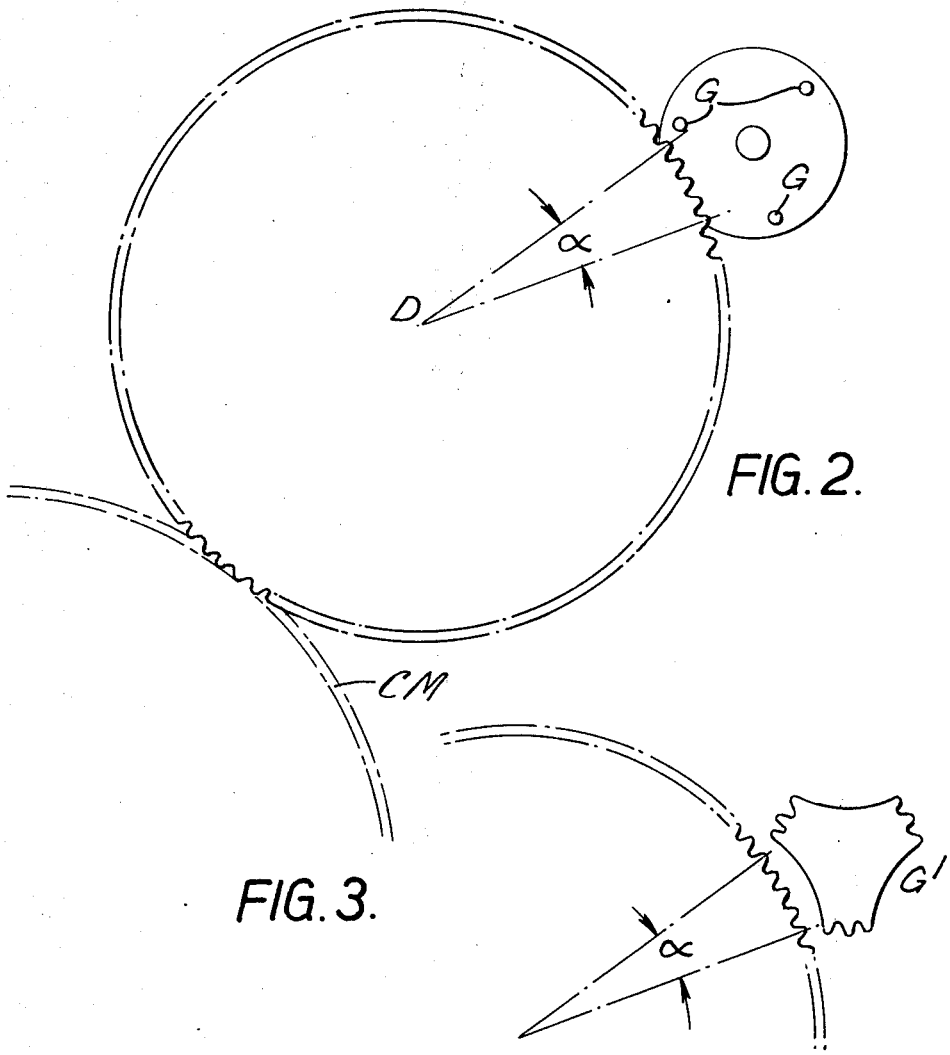
FIG. 2.
FIG. 3.
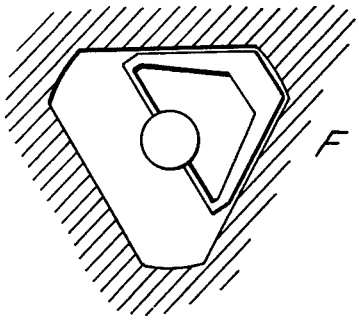
FIG. 4.

ELECTRICALLY POWERED TIMEPIECE

The present invention concerns time-pieces utilizing high precision time standards and is more particularly concerned with the problem of simplifying such time-pieces to the point where they may be reduced to a size suitable for use as a lady's wrist watch.

In speaking of high precision time standards the present attention is heavily concentrated on the use of quartz crystals which determine the frequency of an oscillator. In general the basic quartz frequency is upwards of 8,000 Hz and in certain proposals may exceed 2,000,000 Hz. This frequency normally is reduced by means of a frequency divider circuit to a frequency which is suitable for driving an electro-mechanical transducer for example a stepping motor. Although quartz crystals have been mentioned other high precision time standards may likewise be used in conjuncton with the present invention as for example tuning forks or atomicly based frequency standards.

In time-pieces following the more traditional patterns with which the present invention is concerned, the output of the electro-mechanical transducer is transmitted through a gear train and used to drive the usual indicating hands and possible as well a calender mechanism. In view of the high precision expected for this type of time standard, time-pieces exist on the market already which vary no more than 5 seconds per month. Such time-pieces however are relatively speaking large, complicated and delicate and generally unsuited to being applied as lady's wrist watches.

The present invention seeks to reduce to some degree the complication and hence the sensitivity and thereby permit a reduction in size while at the same time conserving the essential features of extreme accuracy which characterize the present generation of electronic time-pieces.

In conjuncton with the foregoing it is noted that with an average gain or loss not exceeding 5 seconds per month, the gain or loss during the period of a year should not exceed 1 minute. On this basis it is feasable that for certain time-pieces, such as for instance many lady's time-pieces and dress watches, no second hand is provided. Since the overall variation does not exceed 1 minute per year, it can be concluded that there is no real need to provide any corrections for the minute hand since such corrections as may be necessary, can be applied on a yearly basis by the jeweller at the time the battery is changed.

It will still be necessary however to preserve the possibility of correcting the hour hand and the calender if such is provided. Hour hand corrections for example are necessary when crossing time zones or in countries where there is a winter and a summer time. Such corrections, when made, must not of course interfere in any way with the normal running of the time-piece.

Accordingly the invention comprises an electrically powered time-piece having as indicators at least a minute hand and an hour hand and which comprises a high precision time standard and a motor controlled by the time standard, wherein a positive kinematic mechanism connects the motor to the minute hand arbor and a non-positive kinematic mechanism connects the minute hand arbor to the hour hand pipe, so as to permit setting by the user of the hour hand only.

For better understanding of the invention reference will now be had to the drawings in which:

FIG. 2 is a top plan view showing a detail of one type of corrector mechanism.

FIG. 3 is a top plan view of a detail for an alternate corrector mechanism.

FIG. 4 is a bottom plan view of the corrector mechanism as seen from outside of the time-piece.

Figure 1:
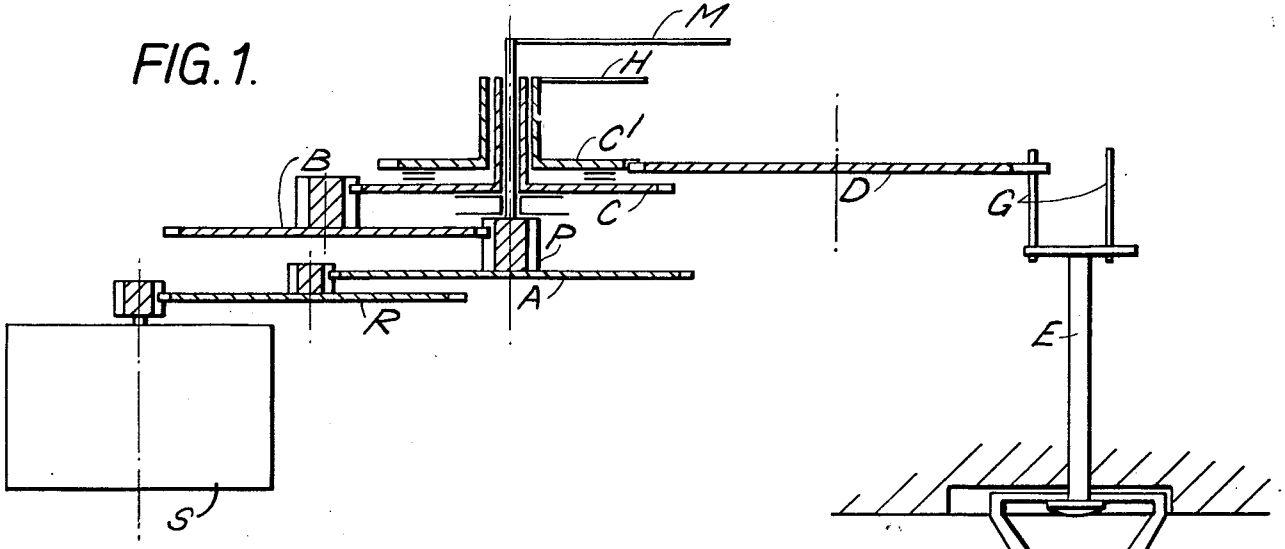
FIG. 1 represents a cross section through a time-piece to which the present invention is applied.
Figure 5:
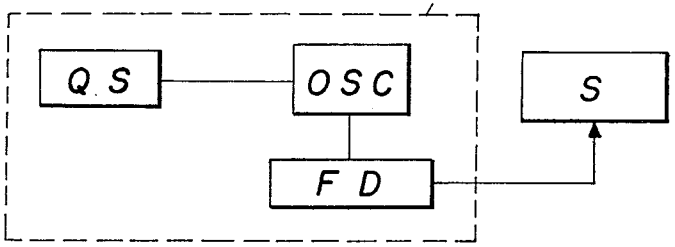
FIG. 5 is a block circuit diagram of a suitable electrical drive means.

In FIG. 5 there is shown a stepping motor S driven by electrical means such as a high precision time standard TS. The time standard, may, in a typical example, comprise a quartz crystal (QC) controlled high frequency oscillator (OSC), a frequency divider (FD) and of course a miniature battery (not shown) to provide the necessary energy. The motor is not necessarily a stepping motor and could run in a continuous fashion provided that the average speed is completely controlled so as to provide an output corresponding to the high precision provided by the quartz crystal oscillator. A positive drive means comprising a gear reduction unit R (FIG. 1) transmits a movement of the motor directly to the centre gear A which is fixed to the minute hand M. A non-positive drive means connects the hour hand indicator to the minute hand indicator, this non-positive drive comprising a centre gear wheel A, a pinion P, a gear B and an hour wheel comprising two wheels C and C'. The centre gear wheel A has fixed thereto the pinion P whereby a further reduction is effected via gear wheel B, whereby the hour wheel C—C' having a double pipe arrangement is driven at the rate of one revolution within 12 hours. On the outer pipe of the hour wheel C—C' is mounted the hour hand H.

It will be seen from the drawing that parts C and C' can rotate independently of one another. Coupling between the two however is effected by means of a plurality of magnetic spots placed around and proximate the peripheries of wheels C and C'. In the usual embodiment there will be 12 such spots equally spaced about the facing peripheries.

Wheel part C' which is connected to the outer pipe is provided with gear teeth and such gear teeth mesh with a further wheel D which serves to connect the hour wheel to a corrector mechanism and may equally serve to drive a calender mechanism schematically illustrated in FIG. 2 as a gear driven disc on ring CM.

Gear D is engageable by pins G arranged to be rotated by means of a stem E and an externally rotatable key F. Either the pins or the stem should be flexible in order to yield slightly, should there be a tendency to butting between the parts.

FIG. 2 shows one possible arrangement of the pins G relative to wheel D, whereas a variant is shown in FIG. 3 in which, instead of using pins, a mutilated gear G' may be employed. The important point of this arrangement is that when the correction mechanism is not in use, the pins G or the tooth sections of the mutilated gear G' should be completely free of engagement with the teeth of the gear D. Should such not be the case it is obvious that gear D could be locked in a position thereby preventing the advance of disk C' and the hour hand H. To ensure that this does not happen, an arrangement of the correcting key such as shown in FIG. 4 may be employed in which the key may be recessed into a sunken well portion provided for example in the watch casing when the corrector is not in use. The triangular form of the well and corresponding form of the key ensure a definite position of the correcting mechanism when it is not in use so that the pins G or the mutilated gear G′ canot interfere with the normal advance of the hour hand.

By virtue of the magnetic clutch coupling between disk C and C′ it is readily realized that corrections may be easily obtained of the hour hand only while avoiding any interference with the normal running of the timepiece. A precise placing of the magnetized spots ensures that corrections precisely in steps of one hour will take place. It should be noted that the magnetic force existing between disk C and C′ should be sufficiently great to actuate a calender mechanism if one is provided, but at the same time not so great as to cause a reaction on the motor S at the time a correction is effected.

It will be clear from the preceding description that there is no need for the minute hand to advance every second. It is therefore feasible to provide an extended frequency divider so that where a stepping motor is employed this is energized less frequently than once per second and correspondingly, each advance of the hand represents more than one second. Such an arrangement will conserve energy and provide for longer battery life. Should it be desired to add a seconds hand this can be done without departing from the essential teachings herein. Such seconds hand would be positively driven and stepped, for example, once every 2½ seconds.

In the foregoing descriptionand the following claims a positive drive means is defined as a drive means having no lost motion such as might occur in a clutch. A gear or gear train is a typical example. A non-positive drive means is defined as one wherein slippage or lost motion may occur such that one or more elements of the drive means may be moved without causing movement of other elements of the drive means.

What we claim is:

1. In an electrically powered timepiece having at least a minute hand indicator and an hour hand indicator and which comprises a high precision time standard, a stepping motor to drive said indicators, and a frequency divider responsive to the time standard for driving the stepping motor, the improvement comprising:

a positive drive means connecting the motor to the minute hand indicator, an hour hand correcting mechanism, a non-positive drive means connecting the hour hand indicator to the minute hand indicator, whereby the position of the hour hand indicator may be altered without perturbing the minute hand setting or the continued operation of the motor, said frequency divider producing output pulses at a frequency of less than 1 Hz to drive said motor to thereby advance the minute hand indicator by steps representing more than one second.

2. The improvement as claimed in claim 1 wherein said positive drive means comprises a gear train connecting said motor to said minute hand indicator.

3. The improvement as claimed in claim 1 wherein said non-positive drive means comprises a clutch in the form of a pair of axially arranged discs having a plurality of magnetized spots placed around and proximate their respective peripheries; and, wherein a first disc of said pair is fixed to a pipe surrounding a minute hand arbor and is provided with gear teeth around its periphery so as to be positively driven via a gear train from the minute hand arbor and a second disc of said pair is fixed to a hour hand pipe.

4. The improvement as claimed in claim 3 wherein said second disc is provided with gear teeth around its periphery and a further gear is arranged to engage the gear teeth on the second disc; and setting means are arranged and adapted to engage the further gear whereby the hour hand indicator setting may be modified by the user.

5. The improvement as claimed in claim 4 wherein the further gear is additionally arranged and adapted to drive a calendar mechanism.

6. The improvement as claimed in claim 4 wherein the setting means comprises a shaft extending through the base plate of the timepiece and provided with an externally accessible key on one end thereof, and means on the other end adapted to intermittently engage the teeth on the further gear when the key is rotated.

7. The improvement as claimed in claim 6 wherein said means on the other end comprises a plurality of elastic pins.

8. The improvement as claimed in claim 6 wherein said means on the other end comprises a mutilated gear.

9. The improvement as claimed in claim 6 wherein the key is pivotably mounted on the end of the setting shaft and a sunken well is provided to receive the key when not in use, the shape of the key and the shape of the well being such as to ensure that the means are completely disengaged from the teeth on the further gear when the key is not in use.

* * * * *